US007116924B2

(12) United States Patent
Park et al.

(10) Patent No.: US 7,116,924 B2
(45) Date of Patent: Oct. 3, 2006

(54) DELIVERY UNIT AND METHOD WITH A CARRIER VAPOR COLLECTION DUCT AND A CARRIER PURIFIER USING THE SAME

(75) Inventors: Geun-yong Park, Suwon-si (KR); Kwang-ho No, Hwaseong-si (KR); Jeong-hun Pang, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 43 days.

(21) Appl. No.: 10/858,289

(22) Filed: Jun. 2, 2004

(65) Prior Publication Data

US 2005/0135835 A1 Jun. 23, 2005

(30) Foreign Application Priority Data

Dec. 18, 2003 (KR) ..... 10-2003-0092860

(51) Int. Cl.
*G03G 15/00* (2006.01)

(52) U.S. Cl. ..... 399/93; 399/92; 399/250; 399/251

(58) Field of Classification Search ..... 399/93, 399/250, 251, 92, 94, 97
See application file for complete search history.

(56) References Cited

U.S. PATENT DOCUMENTS 5,068,684 A * 11/1991 Abe et al. ..... 355/406
5,130,743 A * 7/1992 Katoh et al. ..... 355/405
5,639,080 A 6/1997 Evans ..... 270/58.28
6,259,871 B1 7/2001 Rider et al. ..... 399/92
6,327,447 B1 * 12/2001 Nakano et al. ..... 399/92

FOREIGN PATENT DOCUMENTS

| | | |
|---|---|---|
| JP | 1990144368 | 6/1990 |
| JP | 1996185110 | 7/1996 |
| KR | 1999-010081 | 3/1999 |
| KR | 10-2003-0065604 | 8/2003 |

OTHER PUBLICATIONS

Office Action from Korean Intellectual Property Office, issued Oct. 6, 2005.

* cited by examiner

*Primary Examiner*—David M. Gray
*Assistant Examiner*—Laura K. Roth
(74) *Attorney, Agent, or Firm*—Roylance, Abrams, Berdo & Goodman, LLP

(57) ABSTRACT

A delivery unit and method for removing carrier vapor in a wet-type printer. The delivery unit includes a delivery guide, delivery rollers and a duct for collecting carrier vapor generated from a paper by the latent heat on the paper passing through the delivery guide in order to prevent the carrier vapor from leaking outside of the printer. The carrier vapor collection duct includes upper and lower housings connected to each other to form a predetermined space therein. The upper housing has a vent on one side thereof and an air inlet on the opposite side. A fan is mounted on the vent. The carrier vapor is collected in the duct of the delivery unit and then sent to the catalyst unit by the fan to be oxidized. Accordingly, the delivery unit can prevent the white carrier vapor generated from the paper passing through the delivery unit from leaking outside the printer.

22 Claims, 5 Drawing Sheets

DELIVERY UNIT AND METHOD WITH A CARRIER VAPOR COLLECTION DUCT AND A CARRIER PURIFIER USING THE SAME

CROSS-REFERENCE TO RELATED APPLICATIONS

This application claims priority under 35 U.S.C. § 119(a) to Korean Application No. 2003-92860, filed Dec. 18, 2003, in the Korean Intellectual Property Office, the entire disclosure of which is incorporated herein by reference.

BACKGROUND OF THE INVENTION

1. Field of the Invention

The present invention relates to a wet-type printer and method. More particularly, the present invention relates to a delivery unit and method having a carrier vapor collection duct for preventing carrier vapor generated from a paper from leaking outside the printer and a carrier purifier using the same.

2. Description of the Related Art

As is known in the art, a wet-type printer uses a solution comprising a toner and a liquid carrier mixed in a predetermined ratio as a developer. An image transferred onto a paper by a transfer belt contains a liquid carrier which evaporates due to the heat applied from a fuser assembly. White carrier vapor generated during the fusing process is visually perceivable and may greatly depreciate the value of the printer.

Therefore, general wet-type printers are designed to collect and oxidize white carrier vapor generated during the fusing process, thereby preventing the vapor from leaking outside the printer. The prevention of carrier vapor leakage is specified as one of the standards for the printer industry.

A paper passed through the fusing assembly is sent to a delivery unit and exits. Since the heat applied from the fuser assembly still remains on the paper and the liquid carrier has not completely evaporated, carrier vapor is generated while the paper is passing through the delivery unit.

However, general wet-type printers do not have any structure or means for removing the carrier vapor generated from the paper passing through the delivery unit. White carrier vapor that leaks outside the printer does not comply with the recommended printer industry standards.

SUMMARY OF THE INVENTION

An aspect of the present invention is to solve at least the above problems and disadvantages and to provide at least the advantages described below. Accordingly, an aspect of the present invention is to provide a delivery unit for a wet-type printer, which comprises a duct for collecting carrier vapor generated from a paper during delivery and preventing the carrier vapor from leaking outside the printer.

Another object of the present invention is to provide a carrier purifier for a wet-type printer, which can remove carrier vapor collected by a carrier vapor collection duct in a delivery unit.

In order to achieve the above-described aspects of the present invention, a delivery unit for a wet-type printer is provided, which comprises a delivery guide for guiding a paper fused with an image to exit, and a duct for collecting carrier vapor generated from the paper by the latent heat remaining on the paper passing through the delivery guide.

The delivery guide includes a pair of facing guide members such as a first guide member and a second guide member, spaced a predetermined interval from each other within the carrier vapor collection duct in order to form a paper path having an inlet and an outlet.

The delivery unit also includes a plurality of delivery rollers for delivering a paper for entering the paper path. The delivery rollers are placed within the carrier vapor collection duct adjacent to the outlet of the paper path.

The first and second guide members have openings for the smooth and efficient evaporation of a carrier.

The carrier vapor collection duct includes upper and lower housings connected to each other to form a predetermined space therein. The upper housing has a vent on one side in order to discharge carrier vapor collected in the space.

On an opposite side, the upper housing has air inlets for leading the air to flow in, thereby facilitating the discharge of the carrier vapor through the vent.

In order to accomplish the above aspect of the present invention, there is also provided a carrier purifier for a wet-type printer, which comprises a delivery unit for guiding a paper which is exiting from the printer and having a duct for collecting carrier vapor generated from the paper, a fan for discharging the carrier vapor collected in the carrier vapor collection duct in a predetermined direction, and a catalyst unit for oxidizing the carrier vapor discharged by the fan.

The delivery unit includes a delivery guide comprising a pair of facing guide members such as a first guide member and a second guide member, spaced a predetermined interval from each other within the carrier vapor collection duct in order to form a paper path with an inlet and an outlet.

The carrier vapor collection duct includes upper and lower housings connected to each other to form a predetermined space. The upper housing has a vent on one side to discharge the carrier vapor collected in the space. The fan is mounted on the vent.

According to an embodiment of the present invention, the carrier vapor generated from the paper during delivery does not leak out from the printer. The carrier vapor is collected in the duct of the delivery unit, and then sent to the catalyst unit by the fan to be oxidized. The delivery unit according to an embodiment of the present invention can prevent the white carrier vapor generated from the paper passing through the delivery unit from leaking outside.

BRIEF DESCRIPTION OF THE DRAWINGS

The above object and other advantages of the present invention will be more apparent from the following detailed description taken in conjunction with the accompanying drawings, in which.

In the drawings, the same or similar elements are denoted by the same reference numerals even though they are depicted in different drawings.

DETAILED DESCRIPTION OF THE PREFERRED EMBODIMENTS

Hereinafter, embodiments of the present invention will be described in detail with reference to the accompanying drawings.

Figure 1:
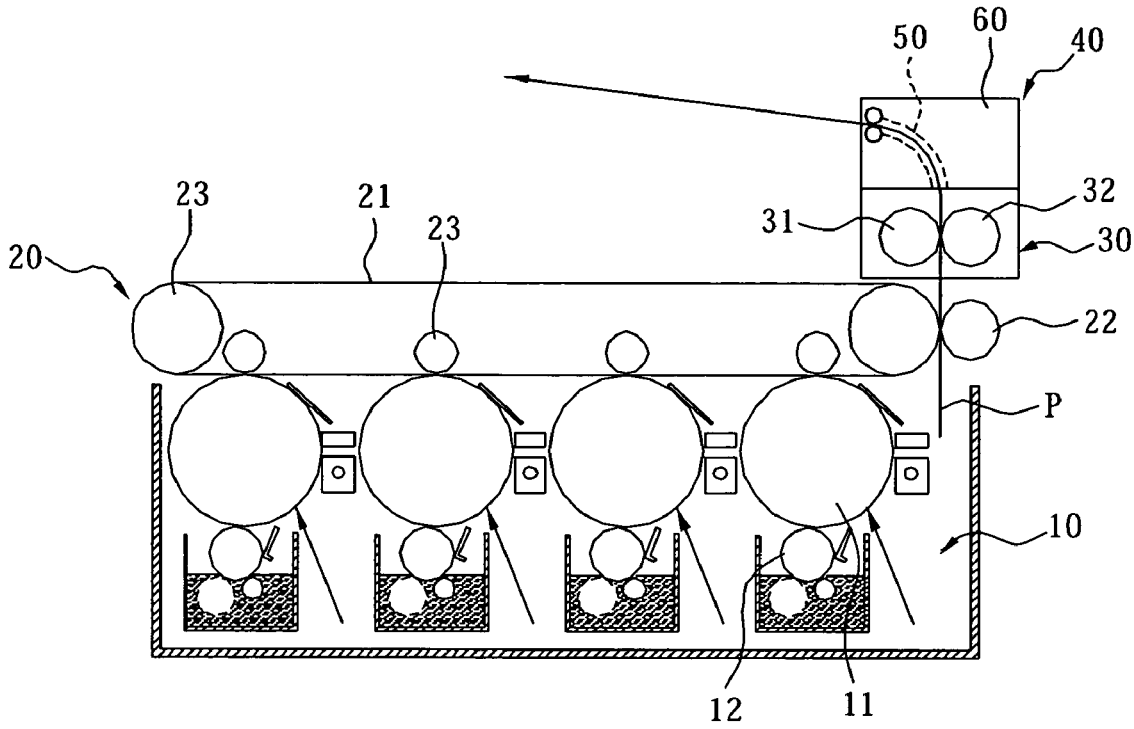
FIG. 1 is a diagram illustrating a wet-type printer having a delivery unit according to an embodiment of the present invention.

Referring to FIG. 1, a reference numeral 10 denotes developer units able to process different colors, 20 denotes a transfer unit, and 30 denotes a fuser unit.

The color developer units 10 each includes a drum 11 and a developing roller 12. The transfer unit 20 includes a transfer belt 21 and a transfer roller 22. The transfer belt 21 is wound around each of a plurality of idle rollers 23. Each drum 11 is positioned to contact the transfer belt 21.

The fuser unit 30 includes a pair of fusing rollers 31 and 32 in contact with each other. A delivery unit 40 includes a delivery guide 50 and a duct 60.

A wet-type printer having the above structure develops a latent image formed on each drum 11 by a developer supplied from the developing rollers 12. The developed image is transferred to the transfer belt 21. The image is then transferred onto the paper P passing between the transfer belt 21 and the transfer roller 22. The transferred image is fused onto the paper P by the heat applied from the fusing rollers 31 and 32. The paper P with the fused image exits through the delivery unit 40.

During the printing process as described, the carrier evaporates from the paper due to the high heat or latent heat applied from the fuser unit 30 and the delivery unit 40. While the carrier vapor generated by the fuser unit 30 can be removed by a conventional printer structure, the vapor generated by the delivery unit 40 can be removed by the characteristic structure of the delivery unit 40 according to an embodiment of the present invention, and a carrier purifier utilizing the same. Consequently, it is possible to prevent the carrier vapor from leaking outside the printer.

Figure 2:
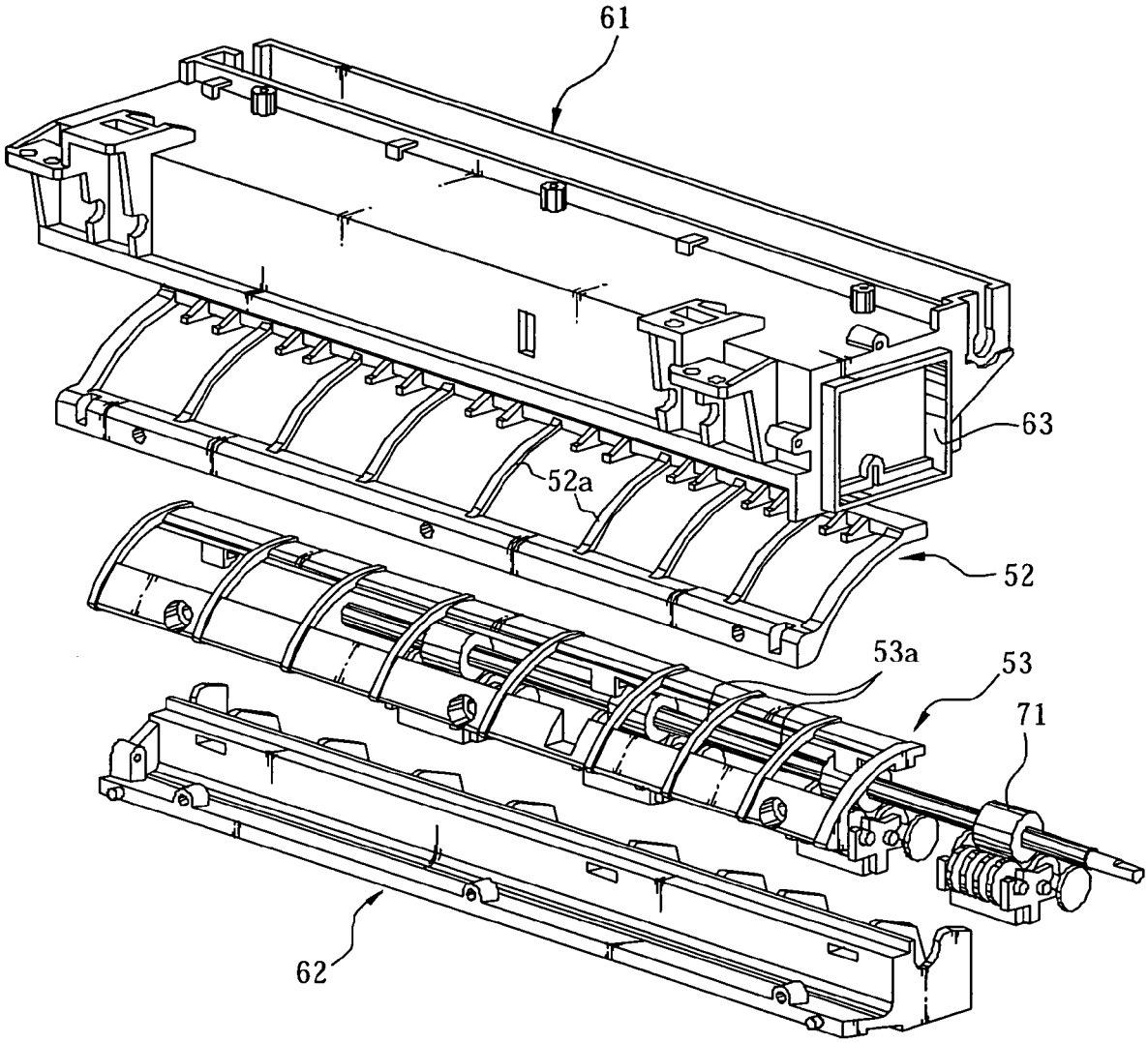
FIG. 2 is an exploded perspective view of a delivery unit according to an embodiment of the present invention.
Figure 3:
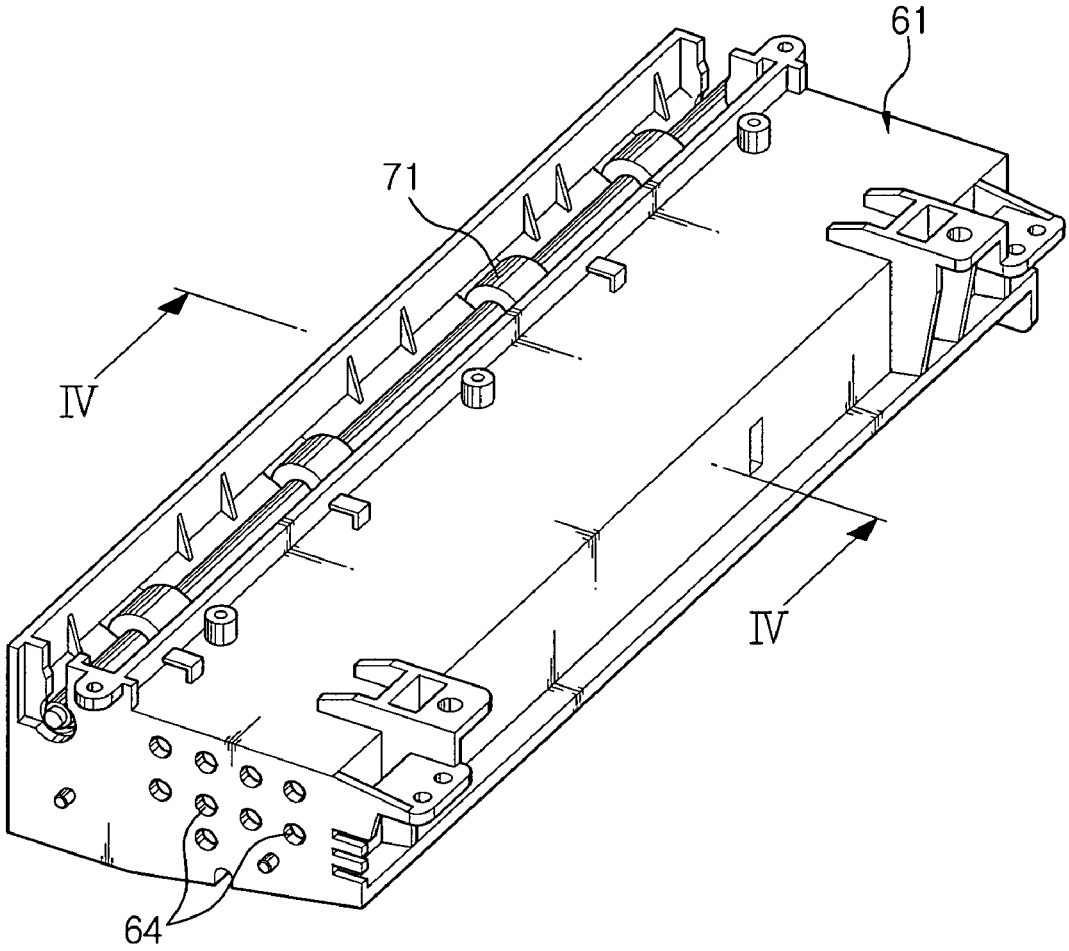
FIG. 3 is an assembled perspective view of a delivery unit according to an embodiment of the present invention.
Figure 4:
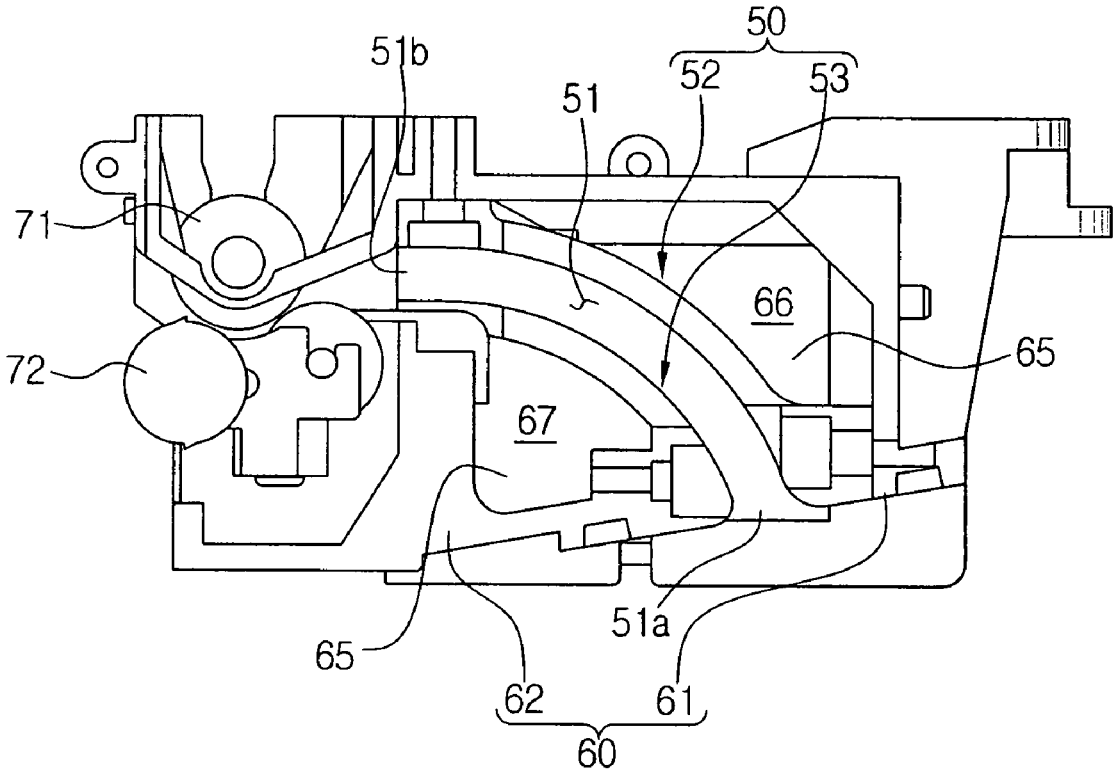
FIG. 4 is a cross-sectional view taken along line IV—IV in FIG. 3.

As shown in FIGS. 2 to 4, the delivery unit 40 includes the delivery guide 50 and the carrier vapor collection duct 60. The delivery guide 50 guides the paper P to exit. The carrier vapor collection duct 60 supports the delivery guide 50 and collects the carrier vapor generated by the latent heat remaining on the paper P in order to prevent leakage of the carrier vapor.

The delivery guide 50 includes a pair of facing guide members such as a first guide member 52 and a second guide member 53, spaced a predetermined interval from each other within the carrier vapor collection duct 60 in order to form a paper path 51 with an inlet 51*a* and an outlet 51*b*. For smooth and efficient evaporation, the first and second guide members 52 and 53 are partitioned by a plurality of guide ribs 52*a* and 53*a*.

The carrier vapor collection duct 60 includes upper and lower housings 61 and 62 connected to each other to form a predetermined space 65 therein. The upper housing 61 has a vent 63 on one side thereof to discharge carrier vapor collected in the above described space. On the opposite side, the upper housing 61 has air inlets 64 (FIG. 3) for leading the air to flow in, thereby facilitating the discharge of the carrier vapor through the vent 63.

The delivery guide 50 is disposed in the predetermined space 65 formed by the upper and lower housings 61 and 62. The first guide member 52 of the delivery guide 50 forms a first air passageway 66 located between the delivery guide 52 and the upper housing 61. The second guide member 53 of the delivery guide 50 forms a second air passageway 67 located between the second guide member 53 and the lower housing 62.

The delivery unit 40 also comprises upper and lower delivery rollers 71 and 72 to provide a driving force to the paper passing through the paper path 51. The delivery rollers 71 and 72 are provided near the outlet 51*b* of the paper path 51 of the duct 60. The paper P is fed between the delivery rollers 71 and 72, and thereby kept moving until the printing process is completed.

As stated above in connection with the prior art, the heat applied from the fuser unit 30 partially remains on the paper P. Also, the carrier is not completely evaporated when the paper P passes through the fuse unit 30. Therefore, the carrier vapor is continuously generated while the paper P is passing through the delivery unit 40. The carrier vapor generated by the delivery unit 40 does not leak outside the printer as in the prior art. According to an embodiment of the present invention, the carrier vapor is collected by the carrier vapor collection duct 60, and removed by a carrier purifier which will be explained below.

Figure 5:
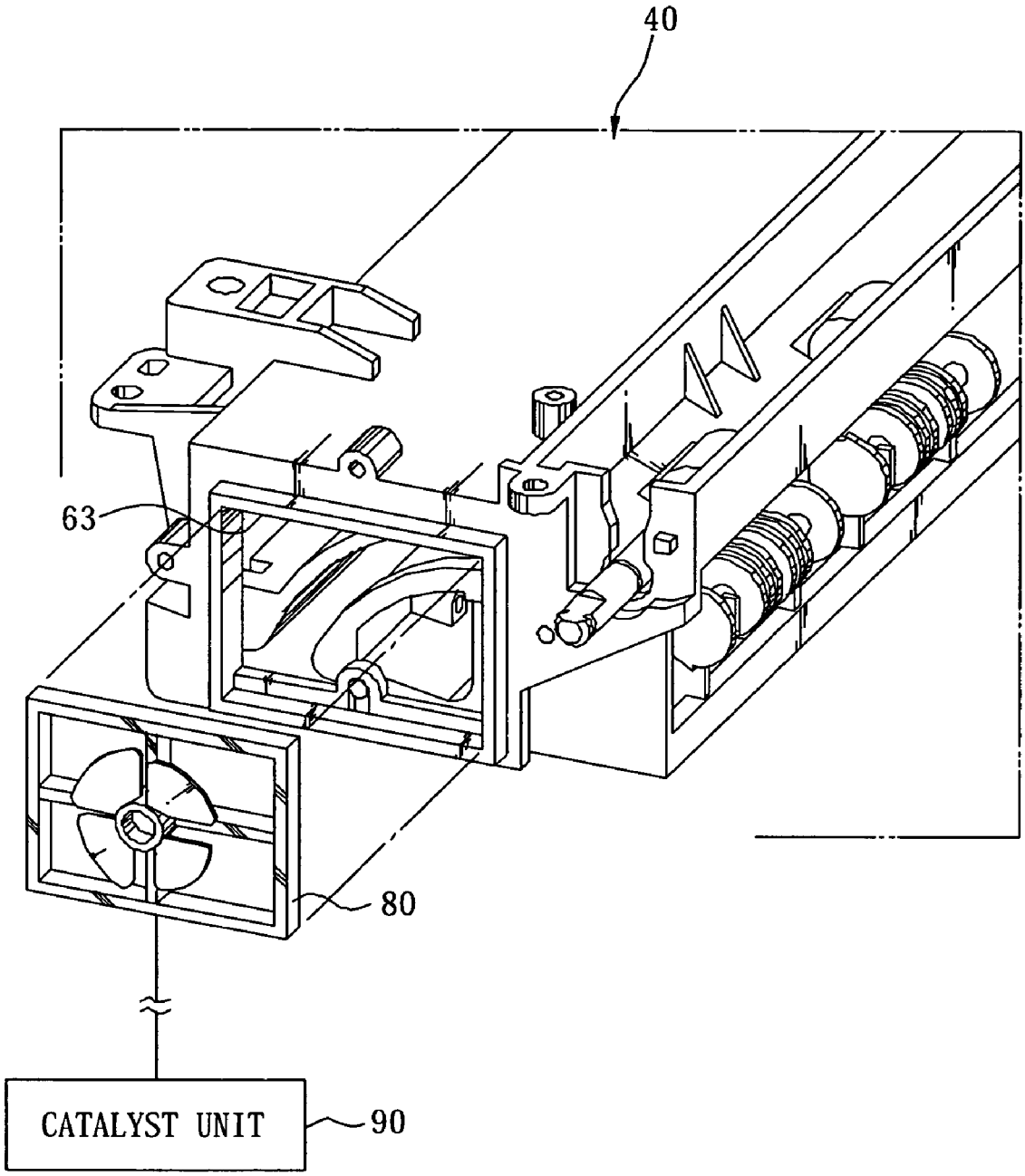
FIG. 5 is a diagram illustrating a carrier purifier according to an embodiment of the present invention.

FIG. 5 is a block diagram illustrating a carrier purifier for a wet-type printer according to an embodiment of the present invention using the delivery unit 40.

As shown in FIG. 5, the carrier purifier according to an embodiment of the present invention includes the delivery unit 40 which guides a paper to exit and has a function of collecting carrier vapor generated from the paper, a fan 80 for discharging the carrier vapor collected in the delivery unit 40, and a catalyst unit 90 for oxidizing the carrier vapor discharged by the fan 80.

Since the structure and function of the delivery unit 40 have been explained, further explanation will be omitted. The fan 80 is mounted onto the vent 63 of the carrier vapor collection duct 60 which is an element of the delivery unit 40. The fan 80 draws in and discharges the carrier vapor collected in the duct 60. The catalyst unit 90 is connected to the fan 80 by a duct (not shown) or the like.

According to an embodiment of the present invention, the carrier vapor generated during the paper exit due to the latent heat remaining on the paper is collected in by the duct of the delivery unit, and sent to the catalyst unit to be removed by oxidization. Therefore, the delivery unit according to an embodiment of the present invention complies with the printer standards restricting the leakage of carrier vapor.

Although an embodiment of the present invention has been described for illustrative purposes, the present invention should not be limited to the configuration or operation set forth herein. Those skilled in the art will appreciate that various modifications, additions and substitutions are possible, without departing from the scope and spirit of the present invention as disclosed in the accompanying claims.

What is claimed is:

1. A delivery unit for a wet-type printer, which comprises:

a delivery guide for guiding a paper fused with an image to exit the printer along a paper path, the delivery guide comprising a first guide member and a second guide member spaced a predetermined interval from each other within the carrier vapor collection duct to form the paper path;

a duct for collecting carrier vapor generated from the paper by the latent heat remaining on the paper which passes through the delivery guide, the duct comprising an upper housing and a lower housing, the delivery guide being disposed in the duct to form a first air passageway located between the first guide member and the upper housing and a second air passageway located between the second guide member and the lower housing, the first and second air passageways being substantially coplanar with the paper path; and a vent arranged on one side of the duct to discharge the carrier vapor collected in the space and an inlet arranged on the side opposite to the vent to direct airflow through the first and second air passageways to facilitate the discharge of the carrier vapor through the vent.

2. The delivery unit according to claim 1, further comprising a plurality of delivery rollers for delivering a paper that entered the paper path, the delivery rollers being disposed adjacent to the outlet of the paper path within the carrier vapor collection duct.

3. The delivery unit according to claim 1, wherein the first and second guide members respectively have an opening for smooth and efficient evaporation of the carrier.

4. The delivery unit according to claim 1, wherein the vent is disposed on one side of the upper housing.

5. The delivery unit according to claim 4, wherein the upper housing has the air inlet on the side opposite to the vent.

6. A carrier purifier for a wet-type printer, which comprises:

a delivery unit for guiding a paper which is exiting along a paper path from the printer, the delivery unit comprising a delivery guide and a duct for collecting carrier vapor generated from the paper by the latent heat remaining on the paper during the paper exit, the delivery guide comprising a first guide member and a second guide member spaced a predetermined interval from each other to form the paper path, the duct comprising an upper housing and a lower housing, the delivery guide being disposed in the duct to form a first air passageway located between the first guide member and the upper housing and a second air passageway located between the second guide member and the lower housing, the first and second air passageways being substantially coplanar with the paper path; and a vent arranged on one side of the duct and an air inlet arranged on the side opposite to the vent to direct airflow through the first and second air passageways to facilitate the discharge of the carrier vapor through the vent.

a fan for discharging the carrier vapor collected in the carrier vapor collection duct; and a catalyst unit for oxidizing the carrier vapor discharged by the fan.

7. The carrier purifier according to claim 6 wherein the delivery unit includes a plurality of delivery rollers for delivering a paper that entered the paper path, the delivery rollers being disposed adjacent to the outlet of the paper path within the carrier vapor collection duct.

8. The carrier purifier according to claim 6 wherein the first and second guide members respectively have an opening for the smooth and efficient evaporation of a carrier.

9. The carrier purifier according to claim 6, wherein the vent is disposed on one side of the upper housing.

10. The carrier purifier according to claim 9, wherein the upper housing has the air inlet on the side opposite to the vent, and the air inlet includes a plurality of holes.

11. A method for removing carrier vapor in a wet-type printer, the method comprising:

guiding a paper fused with an image to exit the printer via a delivery guide along a paper path; and collecting carrier vapor generated from the paper by the latent heat remaining on the paper via a duct, the duct forming first and second air passageways disposed on opposite sides of the delivery guide;

positioning a vent on one side of the duct to discharge the carrier vapor collected in the space; and positioning an air inlet on the side opposite to the vent to direct airflow through the first and second air passageways in a direction substantially coplanar with the paper path to facilitate the discharge of the carrier vapor through the vent.

12. The method according to claim 11, further comprising:

delivering a paper that entered the paper path via a plurality of delivery rollers, the delivery rollers being disposed adjacent to the outlet of the paper path within the carrier vapor collection duct.

13. The method according to claim 11, wherein the delivery guide includes a first guide member and a second guide member which are spaced a predetermined interval from each other within the carrier vapor collection duct in order to form the paper path having an inlet and an outlet.

14. The method according to claim 13, wherein the first and second guide members respectively include an opening for smooth and efficient evaporation of the carrier.

15. The method according to claim 11, wherein the carrier vapor collection duct includes upper and lower housings connected to each other to form a predetermined space therein, the upper housing having the vent on the one side thereof.

16. The method according to claim 15, wherein the upper housing has the air inlet on the side opposite to the vent to allow the air to flow in.

17. A method for removing carrier vapor in a wet-type printer, the method comprising:

guiding paper exiting along a paper path from the printer via a delivery unit having a delivery guide for forming the paper path and a duct for collecting carrier vapor generated from the paper by the latent heat remaining on the paper during the paper exit, the duct forming first and second air passageways disposed on opposite sides of the delivery guide;

discharging the carrier vapor collected in the carrier vapor collection duct in a predetermined direction via a fan;

oxidizing the carrier vapor discharged by the fan via a catalyst unit; and providing a vent and an air inlet via which air flows through the first and second air passageways in direction substantially coplanar with the paper path to facilitate the discharge of the carrier vapor through the vent.

18. The method according to claim 17, wherein the delivery unit includes a delivery guide comprising a first guide member and a second guide member facing each other and spaced a predetermined interval from each other within the carrier vapor collection duct in order to form the paper path having an inlet and an outlet.

19. The method according to claim 18, further comprising:

delivering a paper that entered the paper path via the delivery unit via a plurality of delivery rollers, the delivery rollers being disposed adjacent to the outlet of the paper path within the carrier vapor collection duct.

20. The method according to claim 18, wherein the first and second guide members respectively have an opening for the smooth and efficient evaporation of a carrier.

21. The method according to claim 17, wherein the carrier vapor collection duct includes upper and lower housings connected to each other to form a predetermined space therein, the upper housing having the vent on one side, and the fan mounted on the vent.

22. The method according to claim 21, wherein the upper housing has the air inlet including a plurality of holes on the side opposite to the vent to allow the air to flow in.

* * * * *